United States Patent [19]

Newsome

[11] Patent Number: 5,003,739

[45] Date of Patent: Apr. 2, 1991

[54] CHIMNEY FACADE SYSTEM

[76] Inventor: R. Wayne Newsome, P.O. Box 39, Columbia, Md. 21045

[21] Appl. No.: 321,645

[22] Filed: Mar. 9, 1989

Related U.S. Application Data

[63] Continuation of Ser. No. 81,804, Aug. 5, 1987, abandoned, which is a continuation-in-part of Ser. No. 868,090, May 29, 1986, Pat. No. 4,686,807.

[51] Int. Cl.[5] ..... E04B 5/48

[52] U.S. Cl. ..... 52/219; 285/43

[58] Field of Search ..... 52/219

[56] References Cited

U.S. PATENT DOCUMENTS

| | | | |
|---|---|---|---|
| 252,064 | 1/1882 | Terwilliger | 126/126 |
| 774,258 | 11/1904 | Lewis | 285/43 |
| 797,856 | 8/1905 | Keith et al. | 52/218 |
| 1,374,866 | 4/1921 | Spencer . | |
| 1,676,544 | 7/1928 | Gilson . | |
| 1,796,048 | 3/1931 | Robinson | 52/89 |
| 2,043,697 | 2/1933 | Deichmann | 52/235 |
| 2,116,118 | 3/1937 | Leash | 126/307 R |
| 2,539,177 | 1/1951 | Baylor . | |
| 2,687,127 | 6/1951 | Leffler . | |
| 3,089,521 | 9/1960 | Paiement | 52/314 |
| 3,278,742 | 8/1964 | Stallard | 52/219 |
| 3,425,178 | 10/1965 | Stone et al. . | |
| 3,460,525 | 8/1969 | Bryant . | |
| 3,464,174 | 9/1969 | Rosenberg | 52/218 |
| 3,466,000 | 9/1969 | Southern et al. . | |
| 3,538,656 | 6/1971 | Anger . | |
| 3,761,551 | 9/1973 | Ogata et al. . | |
| 3,809,051 | 5/1974 | Giroux | 126/126 |
| 3,874,364 | 4/1975 | Fauser . | |
| 4,180,052 | 12/1979 | Henderson | 126/126 |
| 4,259,941 | 4/1981 | Gerdes | 126/120 |
| 4,384,566 | 5/1983 | Smith . | |
| 4,593,510 | 6/1986 | Newsome | 52/314 |

FOREIGN PATENT DOCUMENTS

| | | |
|---|---|---|
| 2635131 | 10/1977 | Fed. Rep. of Germany . |
| 2417922 | 9/1979 | France . |
| 708432 | 5/1954 | United Kingdom . |
| 1121981 | 7/1968 | United Kingdom . |
| 1158253 | 7/1969 | United Kingdom . |

*Primary Examiner*—James L. Ridgill, Jr.

*Attorney, Agent, or Firm*—Morton J. Rosenberg; David I. Klein

[57] ABSTRACT

A pre-fabricated and modular chimney facade system (10) is provided for a chimney stack (12) passing at least partially therethrough. The chimney facade system (10) is adapted to be secured to a roof member (14) of a building structure. The chimney facade system (10) includes a first base housing (18) and a second base housing (20) mounted in vertical relationship each to the other. The first base housing (18) is secured to an external surface of the roof member (14) through internally directed horizontally directed flange members (46). Portions of base housings (18 and 20) are joined together through interfacing relationships of one piece sidewall members (40 and 42) for base housing (18) and L-shaped sidewall panel members (24 and 26) for second base housing (20). First and second base housings (18 and 20) are vertically secured each to the other through nested and interfacing relationships between vertically directed flange members (60 and 62). Chimney facade system (10) provides for a secured structural interface between structural members which is non-visible to external viewers.

9 Claims, 4 Drawing Sheets

CHIMNEY FACADE SYSTEM

This is a continuation of co-pending application Ser. No. 07,081,804 filed on Aug. 5, 1987, which is a continuation-in-part of U.S. patent application Ser. No. 868,090, filed on May 29, 1986, now U.S. Pat. No. 4,686,807.

BACKGROUND OF THE INVENTION

1. Field of the Invention

This invention pertains to pre-fabricated and modular chimney facade systems. In particular, this invention directs itself to a pre-fabricated and modular chimney facade system which at least partially encloses a chimney stack extending external a building structure. More in particular, this invention pertains to a chimney facade system which may be mounted on the roof of a building structure and is only constructed external to the building structure. Further, this invention relates to a chimney facade system which is formed of a plurality of housings with each of the housings being constructed in a one-piece manner formation. More in particular, this invention relates to a chimney facade system where a plurality of vertically stacked base housings may be structurally coupled in a manner which is non-visible to external viewers. Still further, this invention relates to a chimney facade system where vertically disposed and connected base housings are coupled each to the other through interfacing relationship of overlapping and nesting vertically directed flange members. More in particular, this invention relates to a structurally reinforced chimney facade system including a plurality of horizontal flange members associated with each of the base housings to provide interconnecting relation and structural reinforcement of each base housing member in a transverse direction. Further, this invention is directed to a chimney facade system which provides for individual coupling of discrete base housing units in varying combinations to provide a prefabricated and modular type chimney facade structure adaptable to a plurality of building contours. Additionally, this invention pertains to a chimney facade system formed of a multiplicity of base housings which may be structurally completed and joined by a single individual. This invention further directs itself to a chimney facade system which is formed of plastic composition materials with individual components being molded in one-piece formation.

2. Prior Art

Chimney facade systems are well-known in the art. The best prior art systems known to Applicant are U.S. Pat No. 4,593,510 and patent application Ser. No. 868,090, filed on 29 May 1986, which are both issued to the Applicant and which this chimney facade system is an improvement thereover. Such prior art chimney facade systems have been successfully used by the Applicant and are commercially applicable to a number of operations. However, neither of the previously mentioned invention concepts direct themselves to a minimization of elements for the chimney facade systems to provide a less costly overall system design. Additionally, such chimney facade systems do not allow for the particular structural interface provided by the subject chimney facade system and further, do not provide for mounting to an external roof member of a building structure, as is provided in this invention concept.

Other prior art known to the Applicant includes the following references which were either developed by the Applicant, or by the U.S. Patent and Trademark Office in the prosecution of Applicant's cases before the U.S. Patent and Trademark Office: U.S. Pat. Nos. 3,538,656; 2,539,177; 3,425,178; 3,464,174; 3,466,000; 4,384,566; 3,460,525; 3,761,551; 3,874,364; 2,687,127; 4,259,941; 797,856; 3,278,742; 3,089,521; 252,064; 4,180,052; 3,809,051; 2,116,118; 1,796,048; 2,043,697; and, 4,593,510.

In some prior art systems such as that shown in U.S. Pat. No. 2,116,118, there is shown chimney structures utilizing metal housings which enclose chimney stacks. However, such systems do not provide for a concatenation of vertically directed housings which are built one upon the other and include the structural constraints of the subject system to allow a series of housing members to be built at the discretion of the user and the constraints of the particular system being provided. Additionally, such prior art systems such as that shown in U.S. Pat. No. 2,116,118, provide for external coupling to wall members of a building structure and such is clearly visible to an external viewer resulting in the fact that the viewer is able to see that the structure is only a simulation. Still further, such prior art chimney structure systems do not provide for internal bracing and internal structural integrity of the systems being provided.

In other prior art systems as depicted in U.S. Pat. No. 1,796,048, there are shown building constructions directing themselves to fireproofing concrete forming the outer surfaces of an overall building structure. Such concepts are directed to a system which may include concrete type structures for enclosing elements such as chimney stacks. However, such prior art systems do not provide for a plurality of vertically stacked, one-piece base housings which may be secured each to the other in a nested overlapping interface as provided in the invention concept. Such systems are not directed to plastic composition molded discrete housing members which may be formed into a unitary structure by an individual. Additionally, such systems do not provide for structures which may be easily transportable to sites in a knockdown fashion and then constructed with a minimization of labor costs.

Other prior art systems are directed to pre-fabricated sectional element systems for chimneys, as is shown in U.S. Pat. No. 3,538,656. However, such chimney system stacks consist of a plurality of one-story high prefabricated sectional elements. Such sectional elements do provide for an outer jacket formed of a concrete composition with a reinforcing steel mat. Such prior art systems are thus formed of relatively heavy type material compositions and do not provide for a plastic material composition to provide a weight saving and labor cost effectiveness. Such systems provide a high weight to volume ratio which increases shipping costs.

In other prior art systems such as that shown in U.S. Pat. No. 4,180,052, there are provided furnace fireplace systems which include outer shells having a metal cabinet covering an inner cabinet. Such prior art systems are generally directed to internally mounted fireplace apparatus and are not amenable to mounting on roof structures, as is provided in the subject invention concept. Such prior art systems extend above a fireplace and pass through a ceiling and through a roof and are not directed to a plurality of housings which are adapted to be mounted external to a building structure.

As is necessary to most prior art systems, panels are generally secured each to the other by welding techniques and are not directed to pre-fabricated and modular chimney facade systems as is necessary to the subject invention concept. Such prior art systems thus do not necessitate the use of structurally reinforcing interfacings as is shown in the subject invention concept.

In still other prior art systems such as that shown in U.S. Pat. No. 252,064, there are provided heating apparatus which may show flange sections, however, such systems do not provide for coupling of one piece housings in a modular fashion, as is necessitated by the invention concept herein described. Such prior art systems do not direct themselves to first and second base housings and are not adaptable to coupling to external walls of building structures utilizing the elemental systems of the subject invention concept wherein the subject invention concept system allows for a strong bonding interface between the system and the external wall of the building structure while maintaining such in a non-visible manner from external viewers.

In still further prior art systems such as that shown in U.S. Pat. No. 2,539,177, there are provided pre-fabricated block flues having a multiplicity of blocks being provided depending upon the height of the overall building structure. However, such blocks are generally formed of a refractory or fireproof material such as cement or firebrick clay. Such prior art systems do not provide for material compositions which allow for ease of varying the height and dimensions of the particular system in an on-site manner. Such systems do not allow for the construction of those prior art systems by a singular person.

In general, prior art systems do not allow for one-piece housings carried by a single person in a simplified fashion. Such prior art systems generally necessitate increased manufacturing, as well as labor costs, in construction and do not provide for non-visible interfacing relationships between various elements which reduces the simulation effect of such prior art systems.

SUMMARY OF THE INVENTION

A pre-fabricated and modular chimney facade system adapted to be secured to an external wall of a building structure. The chimney facade system includes a substantially vertically directed chimney stack passing external the building structure and being substantially enclosed by the chimney facade system. The chimney facade system further includes a substantially vertically directed first base housing adapted to be fixedly secured to the external wall of a building structure and a substantially vertically directed second base housing secured to the first base housing in nested interface therewith.

DESCRIPTION OF THE PREFERRED EMBODIMENTS

Figure 1:
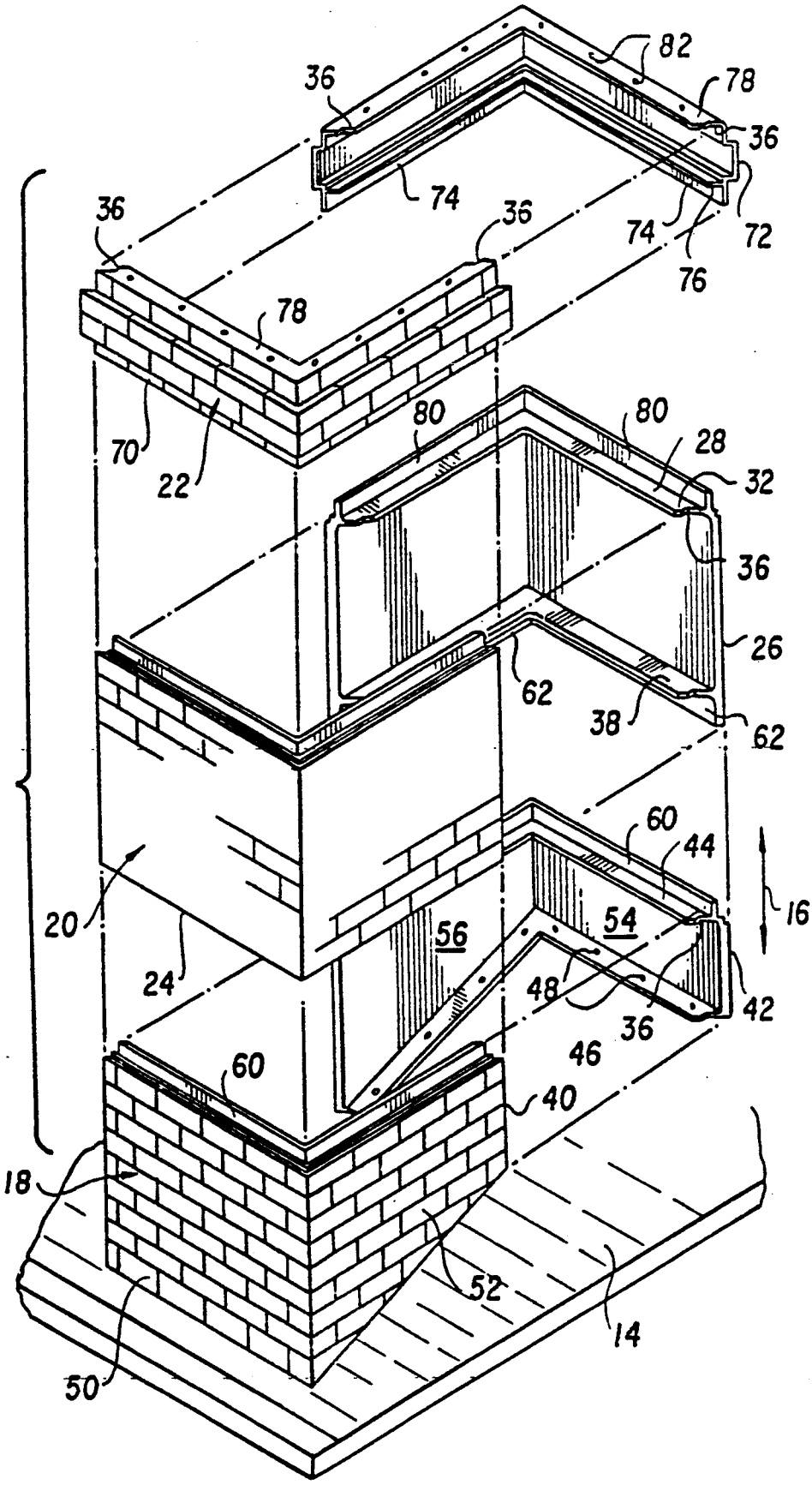
FIG. 1 is a perspective, exploded view of the subject chimney facade system.
Figure 2:
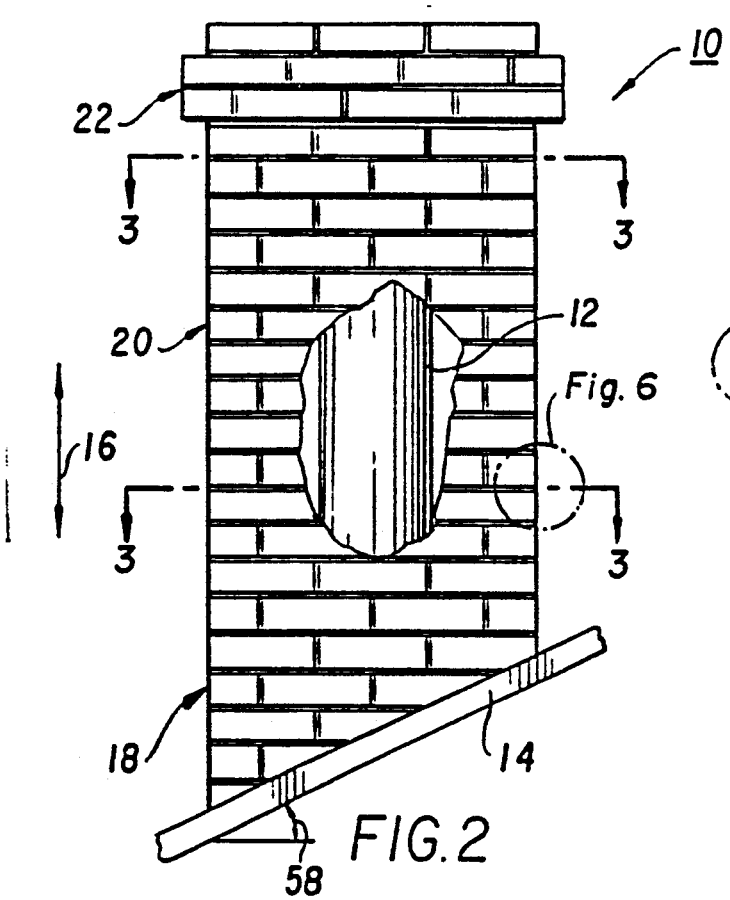
FIG. 2 is an elevational view of the subject chimney facade system in a partially cut-away form.

Referring now to FIGS. 1–8, there is shown prefabricated and modular chimney facade system 10 for enclosing chimney stack 12 passing at least partially therethrough. As is shown in FIGS. 1 and 2, chimney facade system 10 is fixedly secured to external wall or roof 14 of a building structure (not shown) wherein chimney stack 12 may extend from internal the building structure through roof 14.

In overall concept, chimney facade system 10 may be used to provide a pleasing aesthetic representation of a brick facade when viewed external to the building structure. As will be shown in following paragraphs, chimney facade system 10 is formed of a plurality of elements which allow for a pre-fabricated and modular design which allows a minimum of construction time to be utilized as well as affording a simplicity of construction. Further, chimney facade system 10 as will be developed in following paragraphs, is constructed of materials which are substantially less costly than brick facades while simultaneously allowing for low cost of maintenance. Further, chimney facade system 10 is formed of a plurality of constructional elements which in their knockdown state provide for a substantially high weight to volume ratio and minimizes shipping costs which may be considerable. Generally, chimney facade system 10 of the subject invention concept may be used in connection with internal fireplaces or other heating mechanisms used in commercial and/or domestic environments.

Chimney facade system 10 is an improvement in an overall facade system described in U.S. Pat. No. 4,593,510 entitled "Pre-Fabricated and Modular Chimney Facade System" and U.S. patent application Ser. No. 868,090, filed on 29 May 1986, and entitled "Structurally Reinforced Pre-Fabricated and Modular Chimney Facade System". Chimney facade system 10 of the subject invention allows for nesting of facade elements in a manner which optimizes the structural characteristics of the elements and permits an effective low cost system design.

In a number of prior art systems, prior chimney facades have been used and formed of varying structural materials such as brick, wood and other like construction compositions. As will be detailed in following paragraphs, chimney facade system 10 of the subject invention concept provides for a modular system formed of plastic composition materials which are pre-fabricated off-site. Additionally, the lightweight characteristics of the particular facade system composition allows for on-site placement and structural construction by a singular person.

Facade system 10 is formed of a small number of interchangeable sectional housings. Additionally, such sectional housings are easily nested one within the other and thus, the volume is minimized for shipping purposes and provides for easy transportability to the site of the construction. Entire sectional housings may be carried by a single person and installed in a minimum amount of time to decrease labor costs. The plastic composition forming the housing sections of facade system 10 are provided by general molding techniques and allow for a minimum number of overall construction pieces with the cost of materials further being minimized.

U.S. patent application Ser. No. 868,090 was directed to structurally reinforcing the pre-fabricated and modular chimney facade system of the system shown in U.S. Pat. No. 4,593,510. Both of such systems have successfully been tested under varying environmental conditions however, it has now been found that through an overlapping technique between sectional housing members as well as an interfacing mating fit between elements of a housing section, that structural reinforcement considerations may be minimized even under extreme environmental conditions. Chimney facade system 10 has been tested under extreme and varying environmental conditions and provides a system which has been found to have the capability of extended and continuous use over long periods of time while maintaining an aesthetic appearance suitable for chimney facade systems.

Chimney stack 12 may be formed of conventional stainless steel metallic composition or some like material and is surrounded by an insulating air space as is shown in FIG. 2. Air is a well-known high thermal insulator and temperatures on the internal surfaces of facade system 10 have been found to be minimal in nature and well within any temperature criteria for such systems.

In particular, temperatures have been found to rise only a few degrees on the exterior surfaces of facade system 10 even when a fireplace is being used with extremely high temperatures found on the exterior surfaces of chimney stack 12.

Figure 3:
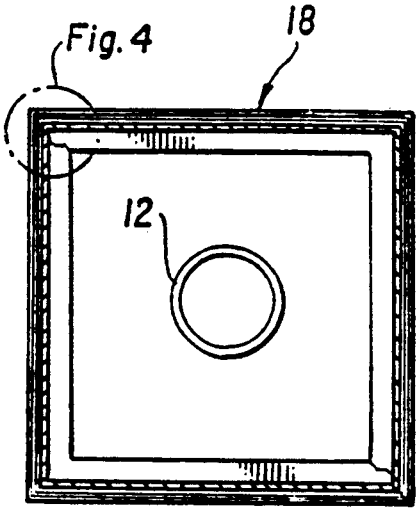
FIG. 3 is a sectional view of the chimney facade system taken along the Section Line 3—3 of FIG. 2.

As is seen in FIGS. 1–3, chimney facade system 10 is formed of a multiplicity of modular housing members which may be stacked in substantially vertical direction 16 to provide the overall structure of facade system 10 when mounted on roof member 14.

It is to be understood that in the following paragraphs there will be descriptions of various housing sections which may be inserted into the overall structure in varying manners and configurations. Some of the housings possibly are removable from certain configurations and additional housings added to other types of configurations responsive to the particular use and particular configuration of a building structure which is not part of the inventive concept of this invention system.

Further referring to FIGS. 1–3, it is seen that facade system 10 includes substantially vertically directed chimney stack 12 passing external the building structure and through external wall or roof member 14. Chimney stack 12 is substantially enclosed by chimney facade system 10, as is seen in FIGS. 2 and 3.

Chimney facade system 10 further includes substantially vertically directed first base housing 18 adapted to be fixedly secured to external wall or roof member 14 of the building structure. Facade system 10, as is seen in FIGS. 1 and 2 further includes substantially vertically directed second base housing 20 secured to first base housing 18 in nested interface therewith. Additionally, cap member 22 is secured to second base housing 20 in a nested interface, as will be described in following paragraphs.

It is to be understood that cap member 22 as herein described may be directly coupled to first base housing 18 and in some configurations and variations, facade system 10 may incorporate first base housing 18 in nested interface with cap member 22 dependent upon the vertical length of chimney stack 12 and other considerations not important to the inventive concept as herein described.

Figure 4:
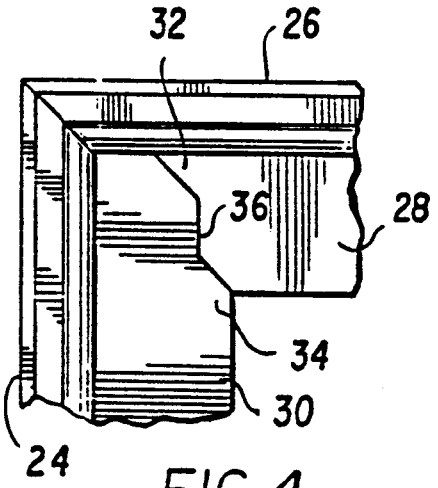
FIG. 4 is a sectional view of an interface between orthogonally directed panels of the chimney facade system.

Second base housing 20 as is seen includes a pair of sidewall members 24, 26 which are L-shaped in cross-sectional contour when taken in a plane normal to vertical direction 16. L-shaped sidewall members 24 and 26 are generally formed in one-piece construction and include interfacing end portions for mating engagement of respective L-shaped sidewall members 24 and 26. As can be seen in FIG. 4, each of L-shaped sidewall members 24 and 26 include a respective horizontally directed flange member 28 and 30 for interface engagement with the substantially horizontally directed other flange member formed on the other of the sidewall members 24 or 26. Each of horizontally directed flange members 28 and 30 include respective end sections 32 and 34 with each of end sections 32 and 34 terminating in step shaped contour 36 for mating interface of flange members 28 and 30, each to the other. Horizontal flange member end sections 32 and 34 may be bonded each to the other through adhesive bonding or some like technique. Additionally, step contour 36 provides for increased surface bonding areas between flange members 28 and 30 and still further, gives the advantage of providing a zig-zag interface which minimizes passage of liquid therethrough providing an operational advantage over an extended time, since facade system 10 is exposed to atmospheric conditions.

In this manner, second base housing L-shaped sidewall members 24 and 26 may be mounted each to the other and adhesively secured to provide an enclosure for chimney stack 12. Additionally, second base housing L-shaped sidewall member 26 may include lower horizontally directed flange member 38 having similar configuration to horizontal flange member 28 but being displaced therefrom in vertical direction 16 as shown in FIG. 1. Lower second base housing horizontal flange member 38 would interface with and be bonded to a similar lower second base housing horizontal flange member formed on L-shaped sidewall member 24.

First base housing 18 as clearly seen in FIG. 1 includes first base housing L-shaped sidewall members 40 and 42. As is seen in FIG. 1, first base housing L-shaped sidewall member 42 includes upper horizontally directed flange member 44 having step-shaped end sections 36 identical to end section contours provided for horizontal flange members 28 and 30 of second base housing 20 previously described.

Further, first base housing 18 includes lower horizontally directed flange member 46 passing around the internal periphery of an internal wall of L-shaped sidewall member 42 for securement to an upper surface of roof member 14. Lower horizontally directed flange member 46 may be secured to roof member 14 by bonded securement or through nails or bolts inserted through bolt holes 48, as is shown. Lower horizontally directed flange member 46 of first base housing L-shaped sidewall member 42 is adapted to be insertable and in nested interface with a similar lower horizontally directed flange member formed on first base housing L-shaped sidewall member 40, as was previously described for second base housing 20.

First base housing L-shaped sidewall member 40 and first base housing L-shaped sidewall member 42 are each formed in one-piece formation and comprise substantially orthogonally directed respective frontal wall member 50, sidewall member 52, and rear wall member 54, and sidewall member 56. When roof inclination angle 58 is greater than zero, as is shown in FIG. 2, opposing sidewall members 52 and 56 are contoured in the shape of a truncated rectangle. Front wall member 50 and rear wall member 54 are of similar rectangular contour, however, such are of differing heights to allow for vertical construction of facade system 10 in vertical direction 16. In this inclined case, lower horizontally directed flange member 46 passes normal to a vertical plane defined by wall members 50, 52, 56 and 54, but as can be seen in FIG. 1, are angled at the inclination angle of roof member 14 in order to allow interfacing and securement of lower horizontally directed flange member 46 with roof or external wall 14.

As can be seen, lower horizontally directed flange member 46 as well as horizontally directed flange member 44 of first base housing 18 are directed inwardly of first base housing 18. In this manner, attachments may be made to roof member 14 as well as between first base housing L-shaped sidewall members 40 and 42 in a manner such that connections are not seen when observed external to facade system 10. This is an important concept in that chimney facade system 10 as constructed should simulate a natural brick facing.

Figure 6:
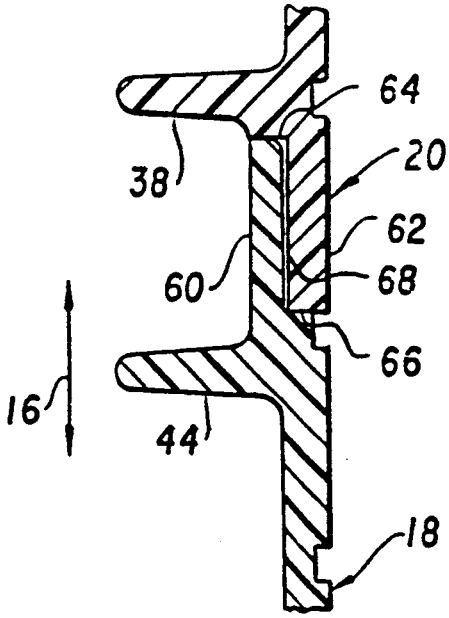
FIG. 6 is a sectional view of a vertical interface structural mounting of a first and second base housing in vertical alignment.

Referring now to FIGS. 1 and 6, there is shown the manner and mode of vertical interfacing of first base housing 18 and second base housing 20. As can be seen, first base housing 18 includes substantially vertically directed upper flange member 60. Second base housing 20 includes substantially vertically directed lower flange member 62 in interfacing relation each with respect to the other. When second base housing 20 is mounted in constructed fashion on first base housing 18, vertically directed flange members 60 and 62 are offset each from the other and provide for nested interface of upper and lower flange members 60 and 62. Horizontally directed flange member 38 provides for shoulder 64 to provide an interface shoulder for upper flange member 60 of first base housing 18. Similarly, interface shoulder 66 is formed on first base housing 18 as shown to provide for a base for vertically directed lower flange 62. Overlapping interface section 68 provides for contact area between vertically directed flange members 60 and 62 and provides for an adhesive bonding section. Alternatively, vertical flange members 60 and 62 may be bolted each to the other within interface area 68 to provide for a secured mounting between first base housing 18 and second base housing 20. The overlapping relationship between vertically directed flange members 60 and 62 provides for an increased adhesive bonding area to reduce transverse stresses applied to first and second base housings 18 and 20 in combination. Flange members 60 and 62 pass substantially throughout the peripheral contour of each section of first and second base housings 18 and 20 to reduce the horizontal stresses which may be applied to facade system 10. Additionally, it has been found that horizontally directed flange members 38 and 40 extending at least partially internal base housings 18 and 20 provides for increased structural integrity of facade system 10 when transverse forces are applied through extreme environmental conditions.

The nesting offset interface of vertical flange members 60 and 62 further provide for increased structural integrity of the combined first and second base housings 18 and 20 while maintaining an aesthetic appearance which does not detract from the external facade visual effect. Thus, if the external indicia is to be that of a brick facing as is depicted in the drawings, the particular overlapping and nested relationship of flange members 60 and 62 maintains the external appearance while providing a stable base for housings 18 and 20 and increasing the combined structural integrity of facade system 10. Additionally, horizontal flange members 38 and 40 in combined relation decrease the transverse stresses applied to the combined housings 18 and 20 and provide for mounting of particular components within each of housings 18 and 20, as has been previously described.

Further, as has been shown, first and second base housings 18 and 20 are mounted completely external the building structure and as depicted are mounted on top of roof member 14. Thus, there is no necessity to destroy roof member 14 when constructing facade system 10, as is herein provided.

Referring now to FIG. 1, cap member 22 includes first cap member L-shaped sidewall members 70 and second cap member L-shaped sidewall member 72. Each of sidewall members 70 and 72 are formed in one-piece formation as was described for first and second base housings 18 and 20. L-shaped sidewall members 70 and 72 each include cap member vertically directed flange 74 which may be mounted in nested and interfacing relation with vertically directed flange 80 of second base housing 20 in exactly the same manner as shown for the interface between first and second base housings 18 and 20 as depicted in FIG. 6. Cap upper horizontal flange 78 extends partially internal the closed contour opening formed by the cross-section of cap member 22 when in the constructed form, and further includes step contours 36 formed on the edges of horizontal flanges 76 and 78 to provide interface and bonded securement between L-shaped sidewall members 70 and 72, as has previously been described for first and second base housing members 18 and 20.

It is to be understood that cap member 22 may be mounted directly to first base housing 18 or in the alternative, there may be a plurality of base housings similar in construction to base housings 18 and 20 upon which cap member 22 may be mounted and secured. Openings 82 may be formed in upper cap horizontal flanges 78 to provide a securement base for a partial closure or other mounting thereon.

Figure 5:
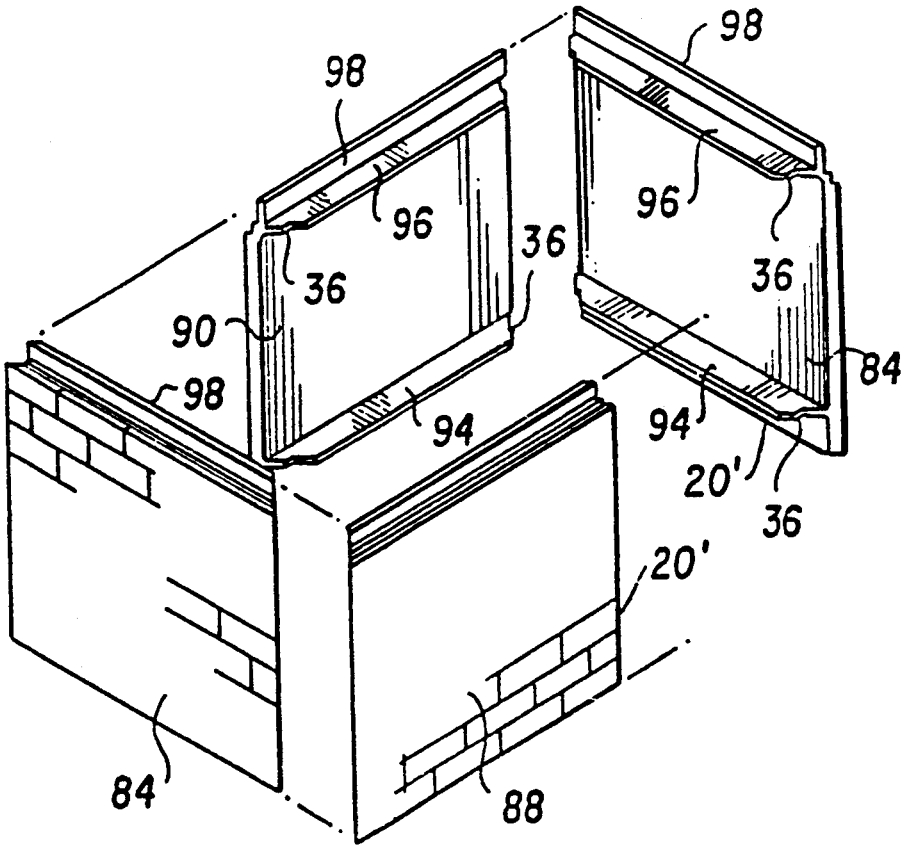
FIG. 5 is an exploded perspective view of an alternative embodiment of the base housing of the chimney facade system.

Referring now to FIG. 5, there is shown an alternate embodiment wherein base housing members such as housing 18 or 20 may be formed of a plurality of substantially planar wall members. In the embodiment shown in FIG. 5, housing base member 20' is formed of housing front and rear walls 84 and 86, as well as transversely displaced sidewalls 88 and 90. Each of substantially planar wall members 84, 86, 88 and 90 include lower horizontally directed flange members 94 which interface each with respect to the other through step contour 36, as has been previously discussed. Additionally, each of wall members 84, 86, 88 and 90 include upper horizontally directed flange members 96 interfacing each with respect to the other in a similar manner to that previously described. Additionally, lower vertical flange members 96 associated with each of the wall members as shown in FIG. 5 interface with a next lower succeeding base housing and upper vertical flange members 98 interface and are in nested relation with a next successively mounted housing section.

Figure 7:
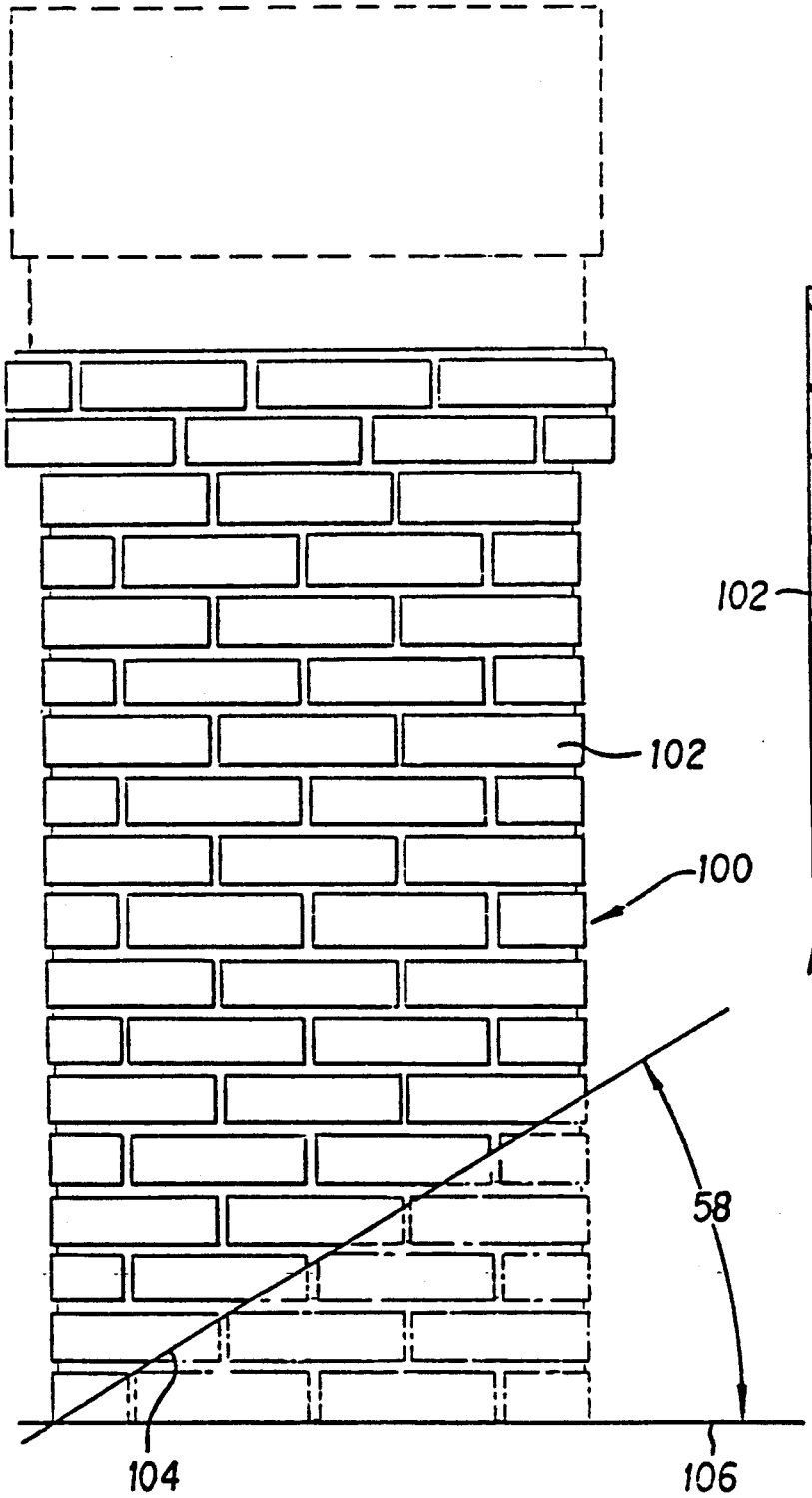
FIG. 7 is an elevational view of an embodiment of the chimney facade system showing a chimney covering in phantom lines; and, FIG. 8 is a sectional view of the chimney face system of FIG. 7.

Referring now to FIG. 7, there is shown pre-fabricated and modular chimney facade system 100 including singular base housing 102. Base housing 102 may be fabricated in the manner shown and described for chimney facade system 10 of FIGS. 1–6. Modular chimney facade system 100 is adapted to be secured to a roof having predetermined pitch angle 58 of a building structure. As was the case for facade system 10 of FIGS. 1–7, there is provided a substantially vertically directed chimney stack 12 passing through the building structure roof and being substantially enclosed by chimney facade system 100. Base housing 102 includes lower surface 104 which is cut to pitch angle 58 of the roof when taken with respect to base line 106.

The important consideration as shown in FIG. 7 is that facade system embodiment 100 may be brought on-site of the building structure and may be cut to the proper roof pitch angle prior to securement. As has been described, base housing 102 subsequent to the cutting thereof may be secured to the roof by adhesive bonding, mechanical bolting, or some like technique, not important to the inventive concept as herein described.

Singular base housing 102 may be formed in one-piece formation and may be formed of a plastic composition material which allows lower surface 104 to be cut and contoured to roof pitch angle 58 with a minimum of effort.

Figure 8:
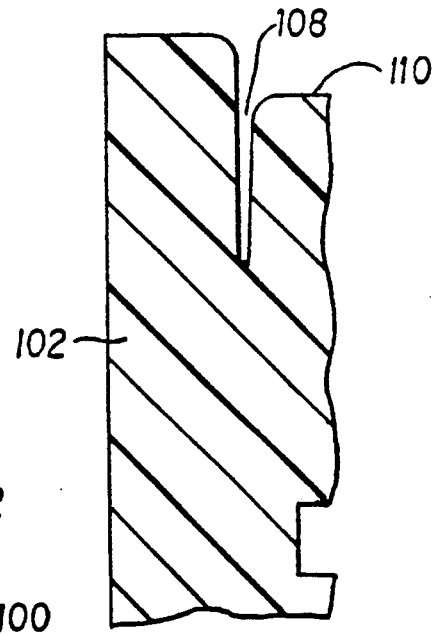

Referring to FIG. 8, there is seen an upper portion of facade system embodiment 100 including channel 108 formed in the upper section of singular base housing 102 and extending substantially throughout a peripheral contour of base housing 102 to provide a flash channel for facade 100. Additionally, inclined upper surface 110 is formed adjacent channel 108 of singular base housing 102 for directing liquid thereto. In this manner, channel 108 may provide a run-off channel for rain water or other liquid impinging on the covering shown in phantom line drawings of FIG. 7.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A pre-fabricated and modular chimney facade system adapted to be secured to a roof having a predetermined pitch angle of a building structure comprising:

(a) a substantially vertically directed chimney stack passing through said building structure roof and being substantially enclosed by said chimney facade system; and, (b) a substantially vertically directed base housing adapted to be fixedly secured to said roof, said base housing having a lower surface cut to said pitch angle of said roof and a channel formed in an upper section of said base housing extending throughout a periphery thereof, said base housing including an inclined upper surface adjacent said channel for directing liquid thereto.

2. The pre-fabricated and modular chimney facade system as recited in claim 1 wherein said base housing is formed in one-piece formation.

3. The pre-fabricated and modular chimney facade system as recited in claim 1 where said base housing is formed of a plastic composition.

4. The pre-fabricated and modular chimney facade system as recited in claim 1 where said base housing includes a pair of sidewall members being L-shaped in cross-sectional contour having interfacing end portions for mating engagement therebetween, said pair of said sidewall members being individually cut to said pitch angle of said roof.

5. The pre-fabricated and modular chimney facade system as recited in claim 4 where each of said L-shaped sidewall members is formed in one-piece formation.

6. The pre-fabricated and modular chimney facade system as recited in claim 4 where each of said L-shaped sidewall members are formed of a plastic material composition.

7. The pre-fabricated and modular chimney facade system as recited in claim 1 where said base housing includes at least four sidewall members, each of said sidewall members being substantially planar in contour having interfacing end portions for mating engagement each to the other.

8. The pre-fabricated and modular chimney facade system as recited in claim 7 where each of said sidewall members is formed in one-piece formation.

9. The pre-fabricated and modular chimney facade system as recited in claim 8 where each of said sidewall members are formed of a plastic material composition.

* * * * *